US011129465B1

(12) United States Patent
Goslin et al.

(10) Patent No.: US 11,129,465 B1
(45) Date of Patent: Sep. 28, 2021

(54) TELESCOPING ARRANGEMENT WITH ILLUMINABLE RINGS

(71) Applicant: Disney Enterprises, Inc., Burbank, CA (US)

(72) Inventors: Michael P. Goslin, Sherman Oaks, CA (US); Clifford Wong, Burbank, CA (US)

(73) Assignee: Disney Enterprises, Inc., Burbank, CA (US)

( * ) Notice: Subject to any disclaimer, the term of this patent is extended or adjusted under 35 U.S.C. 154(b) by 0 days.

(21) Appl. No.: 16/904,303

(22) Filed: Jun. 17, 2020

(51) Int. Cl.

| | |
|---|---|
| ***A45F 5/00*** | (2006.01) |
| ***F21V 21/22*** | (2006.01) |
| ***F21V 21/14*** | (2006.01) |
| ***F21Y 115/10*** | (2016.01) |
| ***F21V 33/00*** | (2006.01) |

(52) U.S. Cl.
CPC ..... *A45F 5/00* (2013.01); *F21V 21/145* (2013.01); *F21V 21/22* (2013.01); *A45F 2005/002* (2013.01); *A45F 2005/008* (2013.01); *F21V 33/008* (2013.01); *F21Y 2115/10* (2016.08)

(58) Field of Classification Search
CPC ..... F21V 21/22; F21V 21/14; F21V 21/145; F21V 21/005; F21V 21/12; F21V 14/02; F21V 14/025; F21V 17/02; F21V 33/008; F21V 33/0084; F21V 33/0004; A45F 2005/002; A45F 2005/008; A45F 2003/003; A45F 2004/003; A62B 3/005; A63B 2225/74; A63H 33/02; A63H 33/009; A63H 33/18; A63H 33/26; A63H 33/22; A63F 2009/2451; F41B 15/025; F41B 15/022; F41B 15/027; B25G 1/04; A47G 2007/066; A47G 19/025
USPC ..... 446/26, 328, 327, 240, 241, 247, 248, 446/253, 266, 485, 487, 489; 472/133; 473/266, 273, 275, 276, 296; 463/47.7
See application file for complete search history.

(56) References Cited

U.S. PATENT DOCUMENTS

| | | | | |
|---|---|---|---|---|
| 3,037,320 A * | 6/1962 | Powell | A63H 33/009 446/473 |
| 4,334,382 A * | 6/1982 | Chase | A63H 33/00 446/490 |
| 4,820,229 A * | 4/1989 | Spraggins | A63H 5/00 446/26 |
| 4,941,460 A * | 7/1990 | Working | A61F 5/05866 473/213 |
| 5,529,357 A * | 6/1996 | Hoffman | A01B 1/026 15/145 |

(Continued)

*Primary Examiner* — Jong-Suk (James) Lee
*Assistant Examiner* — James M Endo
(74) *Attorney, Agent, or Firm* — Patterson + Sheridan, LLP

(57) ABSTRACT

An arm wearable apparatus includes a telescoping arrangement having a plurality of sections, a user interface system that removably attaches the telescoping arrangement with an arm of a wearer, and a plurality of illuminable rings. Each ring of the plurality of illuminable rings is attached with a respective section of the plurality of sections and has an inner diameter such that the plurality of illuminable rings form an opening to receive the arm when the telescoping arrangement is in a retracted configuration. At least some of the plurality of illuminable rings are arranged beyond an extent of the arm when the telescoping arrangement is in an extended configuration.

20 Claims, 15 Drawing Sheets

(56) References Cited

U.S. PATENT DOCUMENTS 5,702,355 A * 12/1997 Repice ..... A61F 5/0118 602/12
6,082,795 A * 7/2000 Fornelli ..... A01B 1/00 16/422
6,306,040 B1 * 10/2001 Chang ..... F41B 15/025 463/47.7
6,350,206 B1 * 2/2002 Lambert, II ..... A63B 57/00 473/205
8,157,664 B2 * 4/2012 Duncan ..... A61F 4/00 473/212
9,661,883 B2 * 5/2017 Neale ..... A41D 13/015
10,617,967 B1 * 4/2020 Oxenford ..... A63J 7/005
2002/0008970 A1 * 1/2002 Hanson ..... F21V 33/0084 362/186
2002/0058459 A1 * 5/2002 Holt ..... A63H 33/22 446/484
2003/0027484 A1 * 2/2003 Kessler ..... A63B 5/22 446/247
2004/0007887 A1 * 1/2004 Elliott ..... A01B 1/00 294/58
2004/0204240 A1 * 10/2004 Barney ..... A63H 30/04 463/36
2006/0183396 A1 * 8/2006 Kanahele ..... A63H 33/006 446/26
2006/0183397 A1 * 8/2006 Kanahele ..... A63H 33/006 446/26
2007/0173338 A1 * 7/2007 Williams ..... A63B 69/3608 473/212
2007/0195520 A1 * 8/2007 O'Brien ..... F21V 21/0816 362/191
2007/0270077 A1 * 11/2007 Woodhouse ..... A63H 33/009 446/473
2007/0276303 A1 * 11/2007 Jenner, Jr. ..... A61F 2/586 602/21
2008/0130268 A1 * 6/2008 Johnson ..... F21V 21/0885 362/103
2011/0103045 A1 * 5/2011 Shay ..... F21V 23/0442 362/157
2011/0290835 A1 * 12/2011 Bartet ..... A45F 5/00 224/267
2012/0011761 A1 * 1/2012 Al-Mutairi ..... A01K 87/007 43/19
2012/0307506 A1 * 12/2012 Gunn ..... F21L 4/005 362/382
2012/0325873 A1 * 12/2012 Stocco ..... A45F 5/00 224/267
2014/0291556 A1 * 10/2014 Bowers ..... F21L 4/00 250/504 R
2014/0357382 A1 * 12/2014 Quail ..... F41B 15/025 463/47.7
2015/0156999 A1 * 6/2015 Roberts ..... A01K 87/04 43/24
2016/0150871 A1 * 6/2016 Favreau ..... A45F 5/00 224/267
2017/0027310 A1 * 2/2017 Garland ..... A47J 45/00
2017/0318788 A1 * 11/2017 Blaylock ..... A01K 27/004
2018/0070710 A1 * 3/2018 Sanneh ..... A45F 5/00

* cited by examiner

TELESCOPING ARRANGEMENT WITH ILLUMINABLE RINGS

BACKGROUND

The present disclosure relates to interactive consumer devices, and more specifically to body-worn or hand-held devices having a telescoping arrangement with illuminable rings.

SUMMARY

In some embodiments, an arm-wearable apparatus comprises a telescoping arrangement comprising a plurality of sections, a user interface system configured to removably attach the telescoping arrangement with an arm of a wearer, and a plurality of illuminable rings. Each ring of the plurality of illuminable rings is attached with a respective section of the plurality of sections and has an inner diameter such that the plurality of illuminable rings form an opening to receive the arm when the telescoping arrangement is in a retracted configuration. At least some of the plurality of illuminable rings are arranged beyond an extent of the arm when the telescoping arrangement in an extended configuration.

In some embodiments, an apparatus comprises a telescoping arrangement comprising a plurality of sections, and a plurality of rings. Each ring of the plurality of rings is attached with a respective section of the plurality of sections. The apparatus further comprises a user interface system attached with the telescoping arrangement and configured to be arm-worn or hand-held by a user. The user interface system when arm-worn or hand-held causes the plurality of rings to form an opening to receive an arm of the user. The apparatus further comprises an active extension system coupled with the telescoping arrangement. The telescoping arrangement is configured to extend from a retracted configuration to an extended configuration responsive to each of force applied through movement of the arm within a sagittal plane, and an input to the active extension system.

In some embodiments, a method comprises arranging a plurality of rings around an arm of a user. Each ring of the plurality of rings is attached with a respective section of a telescoping arrangement. Arranging the plurality of rings around the arm of the user occurs when a user interface system, attached with the telescoping arrangement, is arm-worn or hand-held by the user. The method further comprises, responsive to receiving an input from the user, extending the telescoping arrangement from a retracted configuration to an extended configuration. Receiving the input from the user is one of: applying force applied through movement of the arm within a sagittal plane, and receiving an input to an active extension system.

BRIEF DESCRIPTION OF THE DRAWINGS

So that the manner in which the above recited aspects are attained and can be understood in detail, a more particular description of embodiments described herein, briefly summarized above, may be had by reference to the appended drawings.

It is to be noted, however, that the appended drawings illustrate typical embodiments and are therefore not to be considered limiting; other equally effective embodiments are contemplated.

DETAILED DESCRIPTION

Aspects described herein include an apparatus comprising a telescoping arrangement comprising a plurality of sections, and a plurality of rings, where each ring of the plurality of rings is attached with a respective section of the plurality of sections. The apparatus further comprises a user interface system attached with the telescoping arrangement and configured to be arm-worn or hand-held by a user. When the user interface system is arm-worn or hand-held, the user interface system causes the plurality of rings to form an opening to receive an arm of the user, such that the plurality of rings may be arranged around the arm of the user.

In some embodiments, at least some of the plurality of rings are arranged beyond an extent of the arm when the telescoping arrangement in an extended configuration. In some embodiments, the telescoping arrangement is configured to extend from a retracted configuration to an extended configuration responsive force applied through movement of the arm within a sagittal plane, and/or an input to the active extension system. In some embodiments, the plurality of rings is configured to illuminate as the telescoping arrangement extends.

Beneficially, use of the telescoping arrangement provides a compact, discreet implementation of the apparatus, which makes the apparatus suitable for all wearers, but particularly for smaller wearers, such as children. The compact, discreet implementation of the telescoping arrangement and the illumination of the rings as the telescoping arrangement extends tends to add to the immersive effect.

Figure 1A:
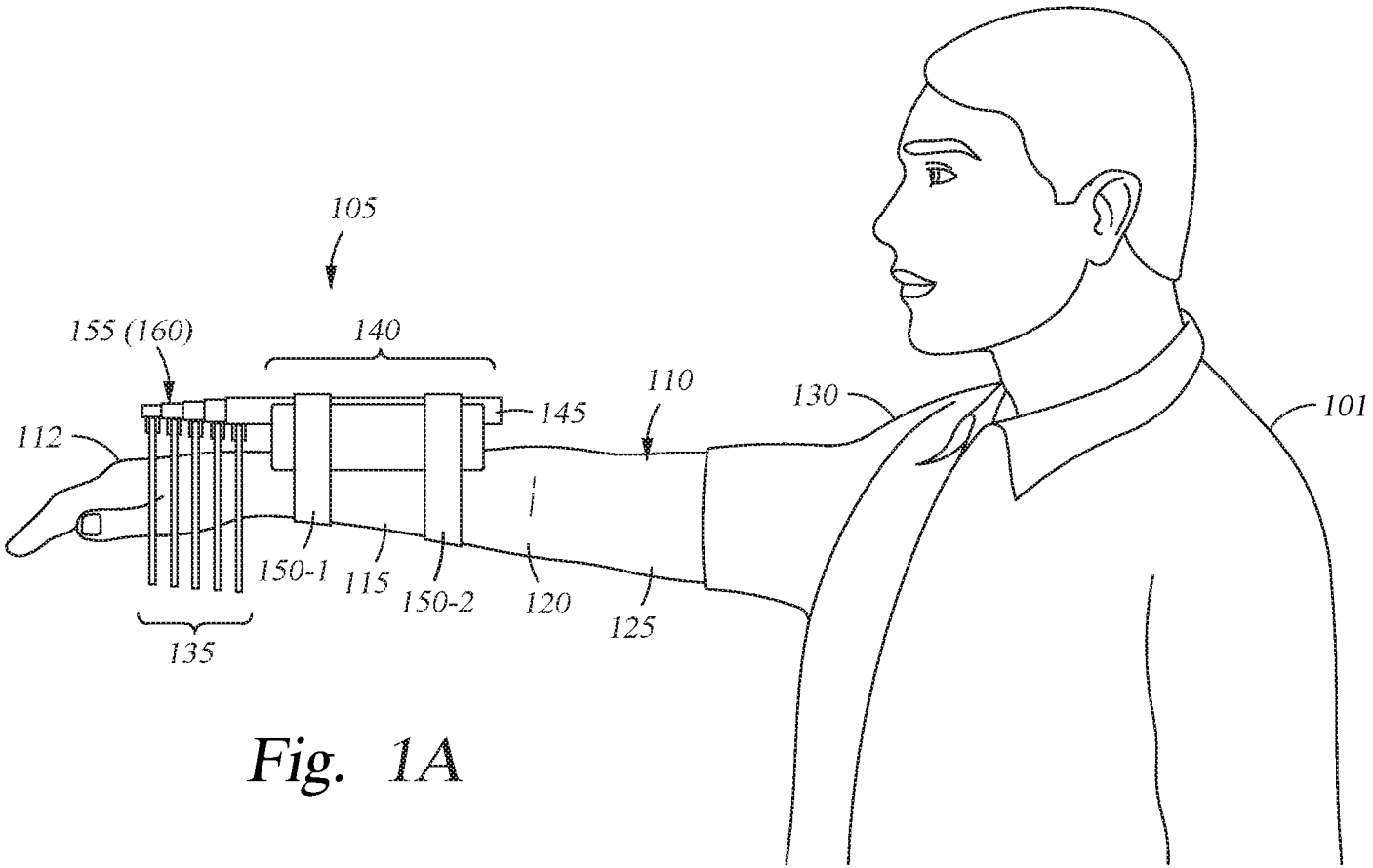
FIGS. 1A, 1B, and 1C are a sequence illustrating an exemplary extension of a telescoping arrangement, according to one or more embodiments.
Figure 1B:
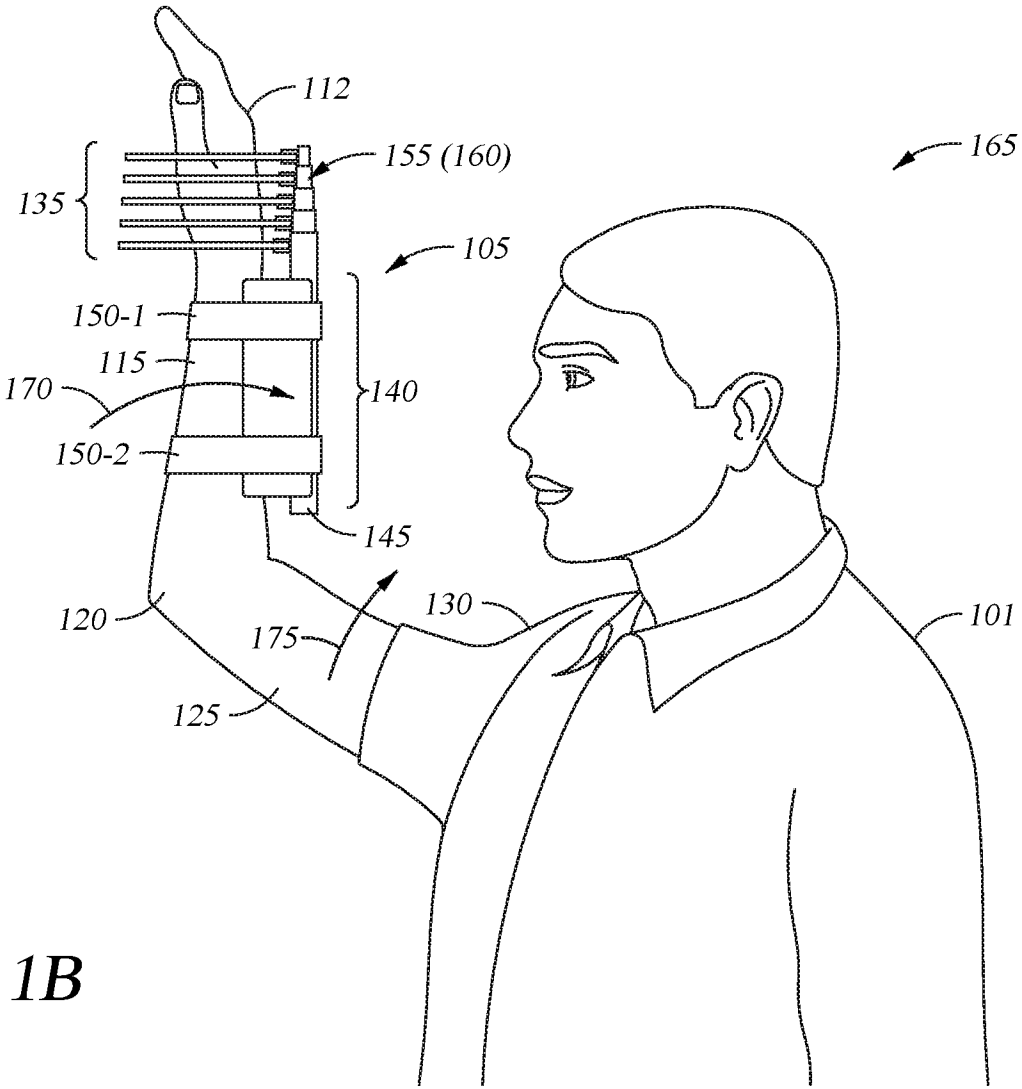
Figure 1C:
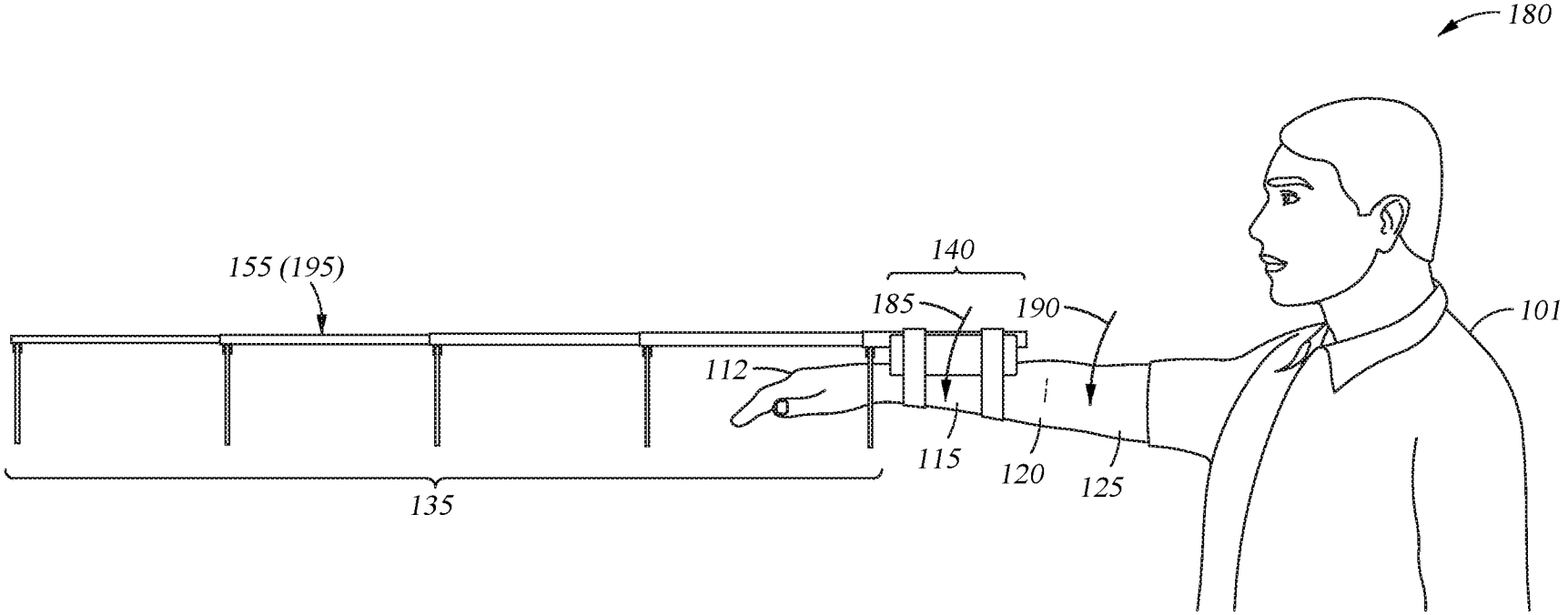

FIGS. 1A, 1B, and 1C are a sequence illustrating an exemplary extension of a telescoping arrangement 155, according to one or more embodiments. In diagrams 100, 165, 180, a user 101 (in this example, a wearer) wears an apparatus 105 on his arm 110, which includes a hand 112, a forearm 115, an elbow 120, an upper arm 125, and a shoulder 130. The arm 110 is extended straight in front of the user 101 (e.g., about 90 degrees shoulder flexion from a neutral position and about zero degrees elbow flexion).

The apparatus 105 comprises a plurality of rings 135 attached with a telescoping arrangement 155. In the diagram 100, the telescoping arrangement 155 is shown in a retracted configuration 160. In some embodiments, the telescoping arrangement 155 comprises a plurality of sections, and each ring of the plurality of rings 135 is removably attached (that is, attached with the capability of being removed) with a respective section of the plurality of sections. The adjacent sections of the plurality of sections are generally slidingly connected with each other (that is, the adjacent sections are capable of sliding with respect to each other) to achieve the telescoping function. The plurality of rings 135 are dimensioned to be arranged around the arm 110, e.g., an inner diameter of the plurality of rings 135 is sufficiently large to receive at least a portion of the arm 110 therethrough. Although the plurality of rings 135 are primarily described throughout the disclosure, other shapes having a sufficiently large inner diameter to receive at least a portion of the arm 110 are also contemplated.

The telescoping arrangement 155 may be formed of any material(s) having suitable resilience for attaching with the plurality of rings 135 and for substantially maintaining the shape of the sections when the telescoping arrangement 155 in the retracted configuration 160 and when in an extended configuration 195. The material(s) may also have suitably low coefficient(s) of friction to permit extension and/or retraction of the telescoping arrangement 155 using force applied by the user 101. Some non-limiting examples of the materials include metals and thermoplastics.

The plurality of rings 135 may be formed of any material(s) having suitable resilience for attaching with the telescoping arrangement 155. The material(s) may also be suitable for illuminating portion(s) or an entirety of each ring of the plurality of rings 135. In some embodiments, each ring of the plurality of rings comprises one or more light sources, such as light-emitting diodes (LEDs). In some embodiments, each ring of the plurality of rings 135 is formed of a substantially transparent material (such as plastic or glass) that illuminates the ring when light is received from an external light source (e.g., a LED in the telescoping arrangement 155).

The apparatus 105 further comprises a user interface system 140 that is attached with the telescoping arrangement 155 and that is arm-worn or hand-held by the user. When the user interface system 140 is arm-worn or hand-held by the user, the plurality of rings 135 are arranged around the arm 110. As shown, the user interface system 140 removably attaches the telescoping arrangement 155 with the arm 110. The user interface system 140 comprises bands 150-1, 150-2 that are spaced apart from each other and that extend around different portions of the forearm 115.

The user interface system 140 further comprises an intermediate structure 145 that attaches the bands 150-1, 150-2 to the telescoping arrangement 155. The intermediate structure 145 may have any suitable dimensioning and composition. For example, the intermediate structure 145 may comprise a rigid member extending along the forearm 115 that maintains a minimum spacing between the telescoping arrangement 155 and the arm 110 (e.g., the forearm 115) to reduce a possibility of contact during operation of the telescoping arrangement 155. In other implementations, the telescoping arrangement 155 may be directly attached to the bands 150-1, 150-2 without using the intermediate structure 145.

The bands 150-1, 150-2 may be formed of any suitable material(s) such as elastic. The bands 150-1, 150-2 may be attached to the telescoping arrangement 155 and/or the intermediate structure 145 using any suitable techniques, such as insertion of the bands 150-1, 150-2 through respective slots formed in the telescoping arrangement 155 and/or the intermediate structure 145, use of mechanical fasteners such as button snaps, and so forth. Alternate implementations of the user interface system 140 may include other types of attachment devices as a substitute for the bands 150-1, 150-2, such as buckled straps, an elastic sleeve, and so forth.

Figure 9:
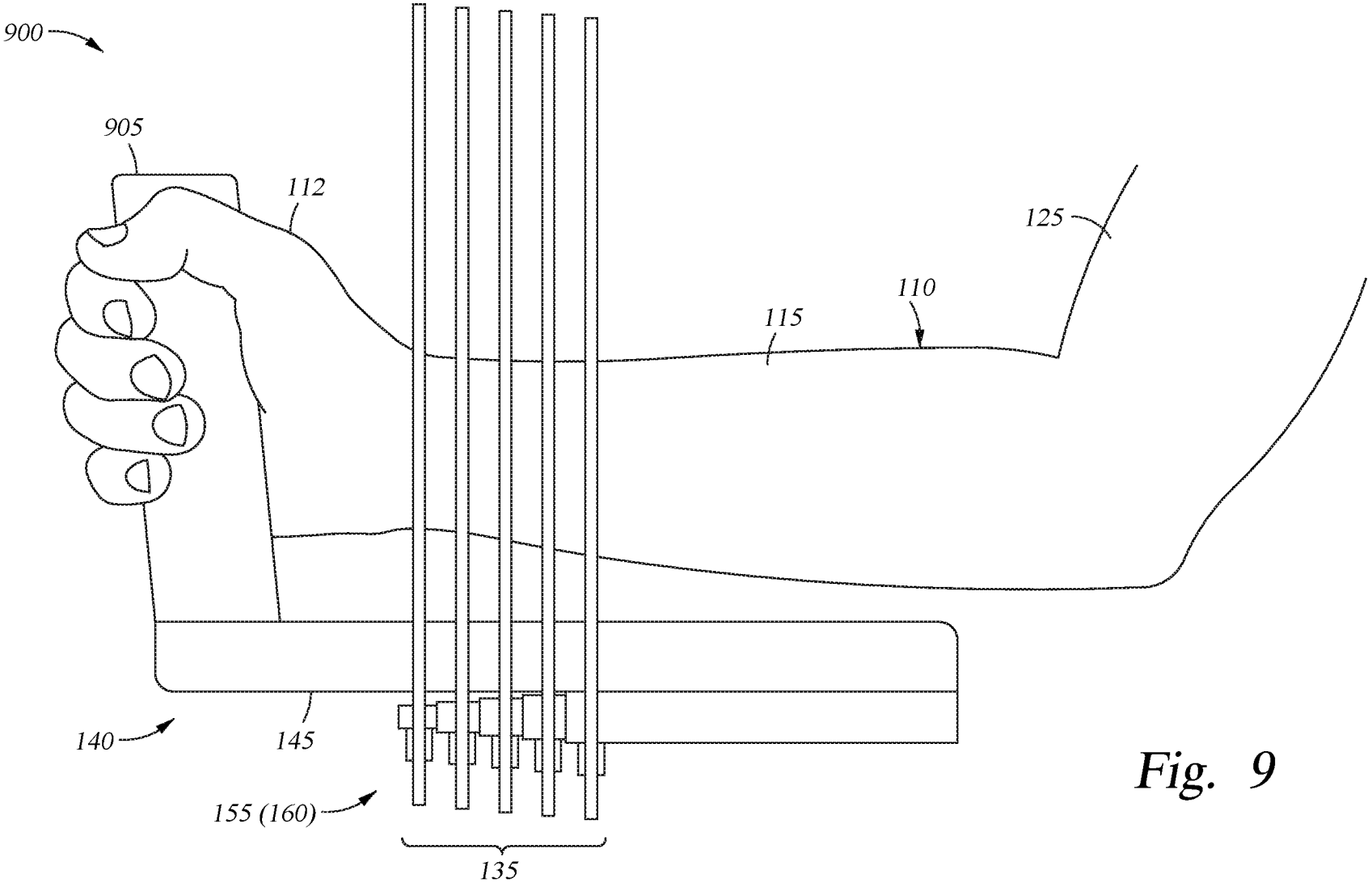
FIG. 9 illustrates an exemplary apparatus with a hand-held user interface system, according to one or more embodiments.

One alternate implementation of the user interface system 140 is depicted in diagram 900 of FIG. 9, in which the hand 112 grasps a handle 905 to arrange the plurality of rings 135 around the arm 110. The handle 905 is attached with the telescoping arrangement 155, either directly or using the intermediate structure 145.

Figure 10A:
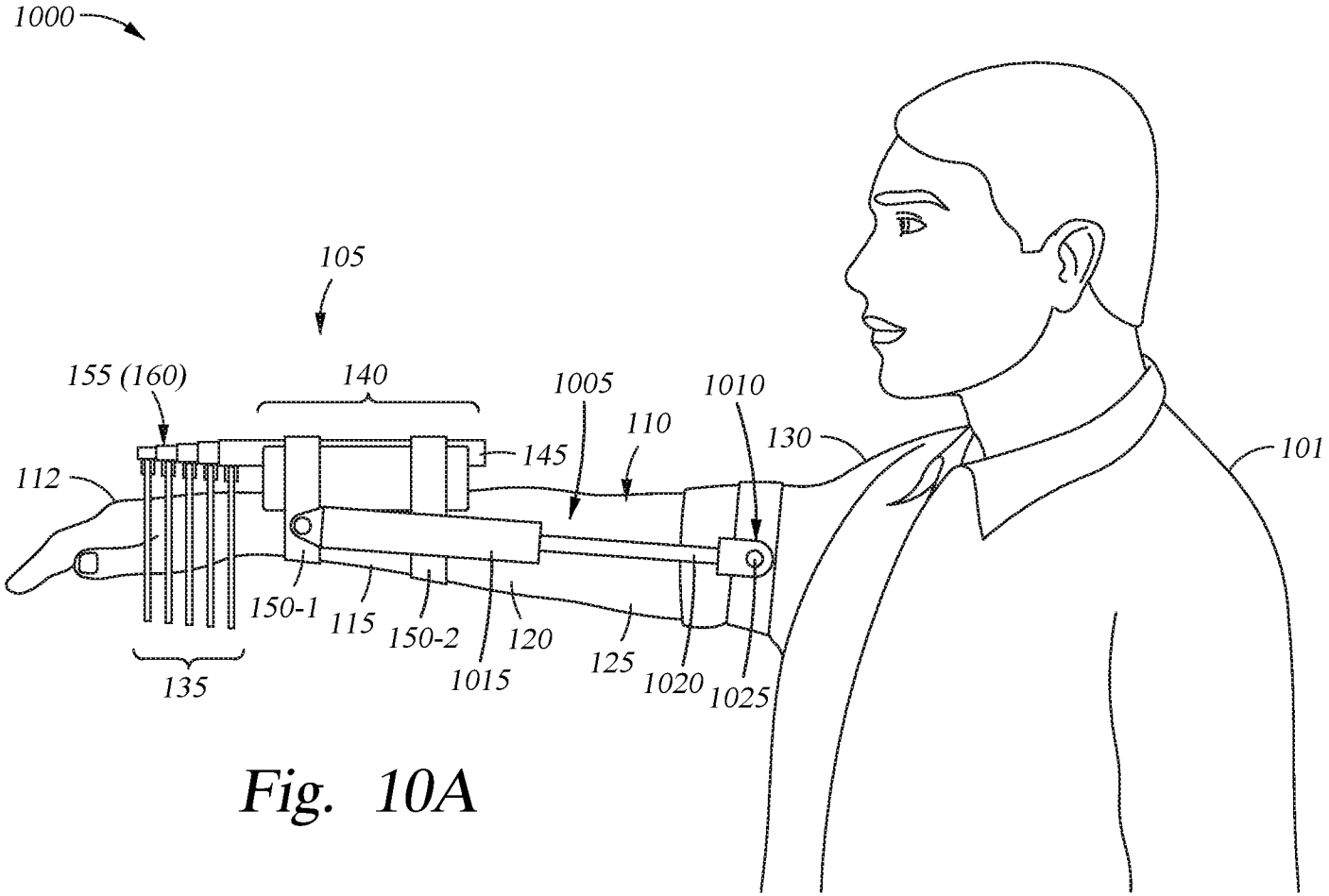
FIGS. 10A and 10B illustrate exemplary operation of an apparatus with multiple portions, according to one or more embodiments.
Figure 10B:
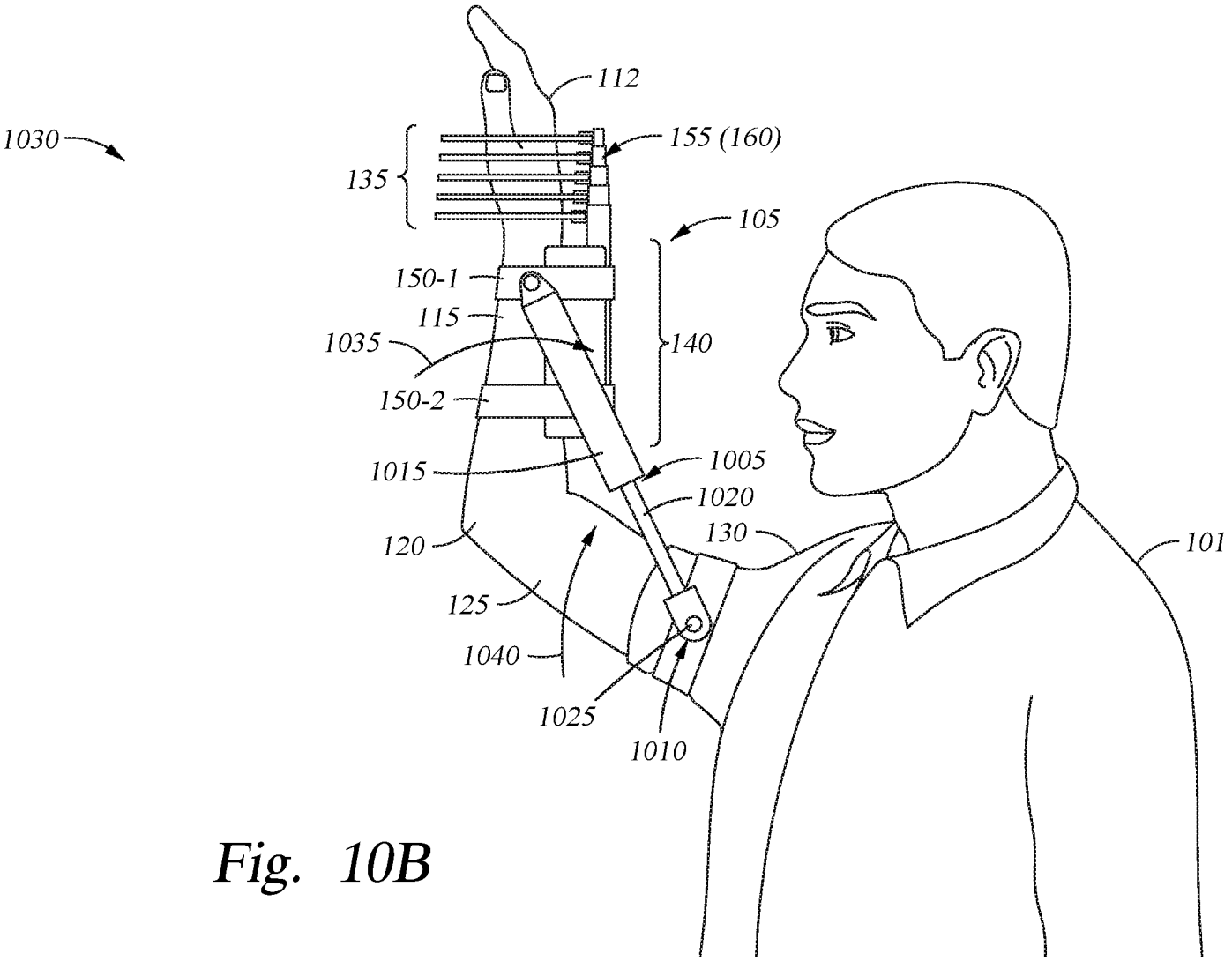

Another alternate implementation of the user interface system 140 is depicted in diagrams 1000, 1030 of FIGS. 10A, 10B. More specifically, the user interface system 140 comprises multiple portions—a first portion 1005 that is removably attached to the forearm 115, and a second portion 1010 attached with the first portion 1005 and that is coupled with the upper arm 125. The first portion 1005 and the second portion 1010 may have any suitable implementation, such as bands or sleeves. In alternate implementations, the first portion 1005 may be hand-held as in the implementation illustrated in diagram 900 of FIG. 9.

In some embodiments, the second portion 1010 removably attaches to the upper arm 125. In other embodiments, the second portion 1010 contacts the upper arm 125 without removable attachment, e.g., a brace that rests against the upper arm 125 when the first portion 1005 is body-worn or hand-held. Additional functionality provided by the multiple-portion user interface system 140 is discussed in greater detail below.

Returning to FIG. 1B, in the diagram 165 the user 101 has moved the arm 110 upward from the forward-extended position depicted in the diagram 100, using shoulder flexion 175 and/or elbow flexion 170. The telescoping arrangement 155 remains in the retracted configuration 160. In some embodiments, the motion depicted in the diagram 165 represents a first stage of a "casting" or "whipping" motion performed by the user 101 to extend the telescoping arrangement 155. In the example shown, the shoulder flexion 175 is about 120 degrees and the elbow flexion 170 is about 70 degrees, although other values are also contemplated for the user 101 to generate sufficient force to extend the telescoping arrangement 155 toward the extended configuration 195.

In the diagram 180, the user 101 has moved the arm 110 downward from the position depicted in the diagram 165, using shoulder extension 190 and/or elbow extension 185. The position of the arm 110 shown in the diagram 180 is comparable to that shown in the diagram 100 (about 90 degrees shoulder flexion and about zero degrees elbow flexion), although other values are also contemplated.

Responsive to the force applied by the user 101 through movement of the arm 110 (e.g., centrifugal force), the telescoping arrangement 155 extends from the retracted configuration 160 to the extended configuration 195. In some embodiments, the motion depicted in the diagram 180 represents a second stage of the "casting" or "whipping" motion. In some embodiments, some of the plurality of rings 135 are arranged beyond an extent of the arm 110 (here, arranged beyond the hand 112) when the telescoping arrangement 155 is in the extended configuration 195. In this way, the user 101 appears to be "throwing" or "casting" the plurality of rings 135 within the interactive experience.

The diagrams 100, 165, 180 depict one exemplary sequence in which an "overhand" casting or whipping motion is used to extend the telescoping arrangement 155. The extension of the telescoping arrangement 155 may also be achieved through other motion of the arm 110 within the sagittal plane. For example, the user 101 may perform an "underhand" casting motion using shoulder flexion and/or elbow flexion to generate sufficient force to extend the telescoping arrangement 155 to the extended configuration 195.

In some embodiments, the plurality of rings 135 are configured to illuminate as the telescoping arrangement 155 extends toward the extended configuration 195, and the visual effect may enhance the interactive experience. In some embodiments, the illumination is controlled using components that are included in different sections of the telescoping arrangement 155. For example, one section may include a switch and an adjacent section may include a pin or other component that prevents the switch from closing when the sections are within a predefined distance from each other. As the telescoping arrangement 155 extends, the sections move apart and the switch closes, establishing electrical contact with a power supply and causing the corresponding ring to illuminate.

In some embodiments, the apparatus 105 may further comprise an active extension system (discussed in greater detail below) that is used to extend the telescoping arrangement 155. The capability of the apparatus 105 to extend the telescoping arrangement 155 using the active extension system may be in addition to, or alternative to, the capability to extend the telescoping arrangement 155 responsive to force applied through arm movement. Using the active extension system, the sequence may progress from the state depicted in the diagram 100 directly to the state depicted in the diagram 180 responsive to an input to the active extension system (e.g., a button press).

The telescoping arrangement 155 may be retracted from the extended configuration 195 to the retracted configuration 160 using any suitable techniques. In some embodiments, the user 101 manually returns the telescoping arrangement 155 to the retracted configuration 160, which in some cases may be gravity-assisted. For example, while the telescoping arrangement 155 is in the extended configuration 195, the user 101 may hold the arm 110 in the state depicted in the diagram 165 to cause the telescoping arrangement 155 to retract. In some embodiments, the apparatus 105 may further comprise an active retraction system that retracts the telescoping arrangement 155 responsive to an input to the active retraction system (e.g., a button press).

In some embodiments, the plurality of rings 135 are configured to dim as the telescoping arrangement 155 retracts toward the retracted configuration 160. For example, the pin of one section may reengage the switch of an adjacent section to open the switch, breaking electrical contact with the power supply and causing the corresponding ring to dim.

Figure 2:
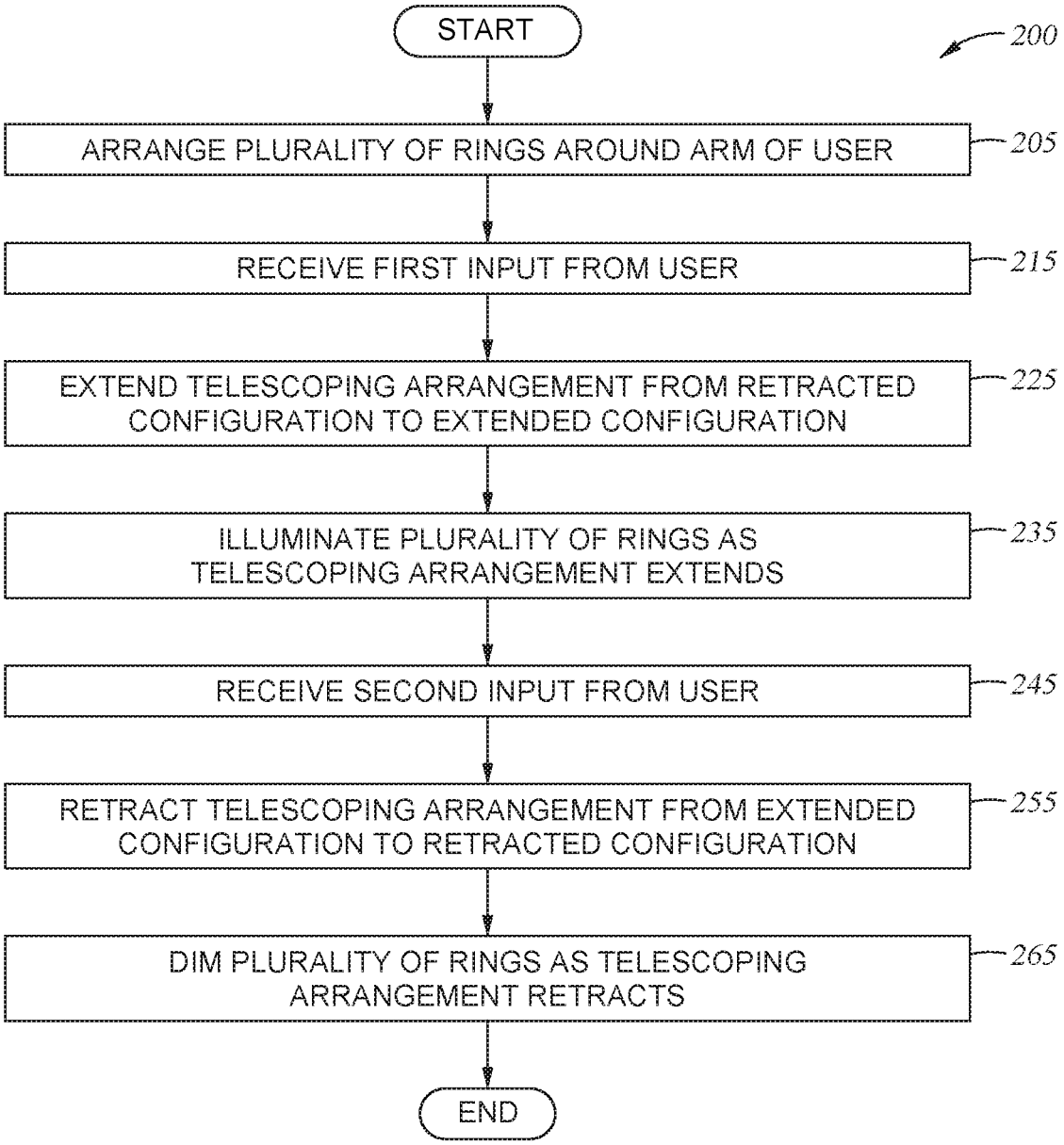
FIG. 2 is an exemplary method of operating a telescoping arrangement, according to one or more embodiments.

FIG. 2 is an exemplary method 200 of operating a telescoping arrangement, according to one or more embodiments. The method 200 may be used in conjunction with other embodiments, e.g., using the apparatus 105 of FIGS. 1A, 1B, and 1C.

The method 200 begins at block 205, where a plurality of rings is arranged around an arm of a user. In some embodiments, a user interface system when arm-worn or hand-held by the user causes the plurality of rings to be arranged around the arm At block 215, the apparatus receives a first input from the user. In some embodiments, the first input comprises force applied through movement of the arm within a sagittal plane. In some embodiments, the first input comprises an input to an active extension system of the apparatus, such as a button press. At block 225, the telescoping arrangement extends from a retracted configuration to an extended configuration. At block 235, the plurality of rings is illuminated as the telescoping arrangement extends.

At block 245, the apparatus receives a second input from the user. In some embodiments, the second input comprises force applied manually by the user, which in some cases may be gravity-assisted. In some embodiments, the second input comprises an input to an active retraction system of the apparatus, such as a button press. At block 255, the telescoping arrangement retracts from the extended configuration to retracted configuration. At block 265, the plurality of rings is dimmed as telescoping arrangement retracts. The method 200 ends following completion of block 265.

Figure 3:
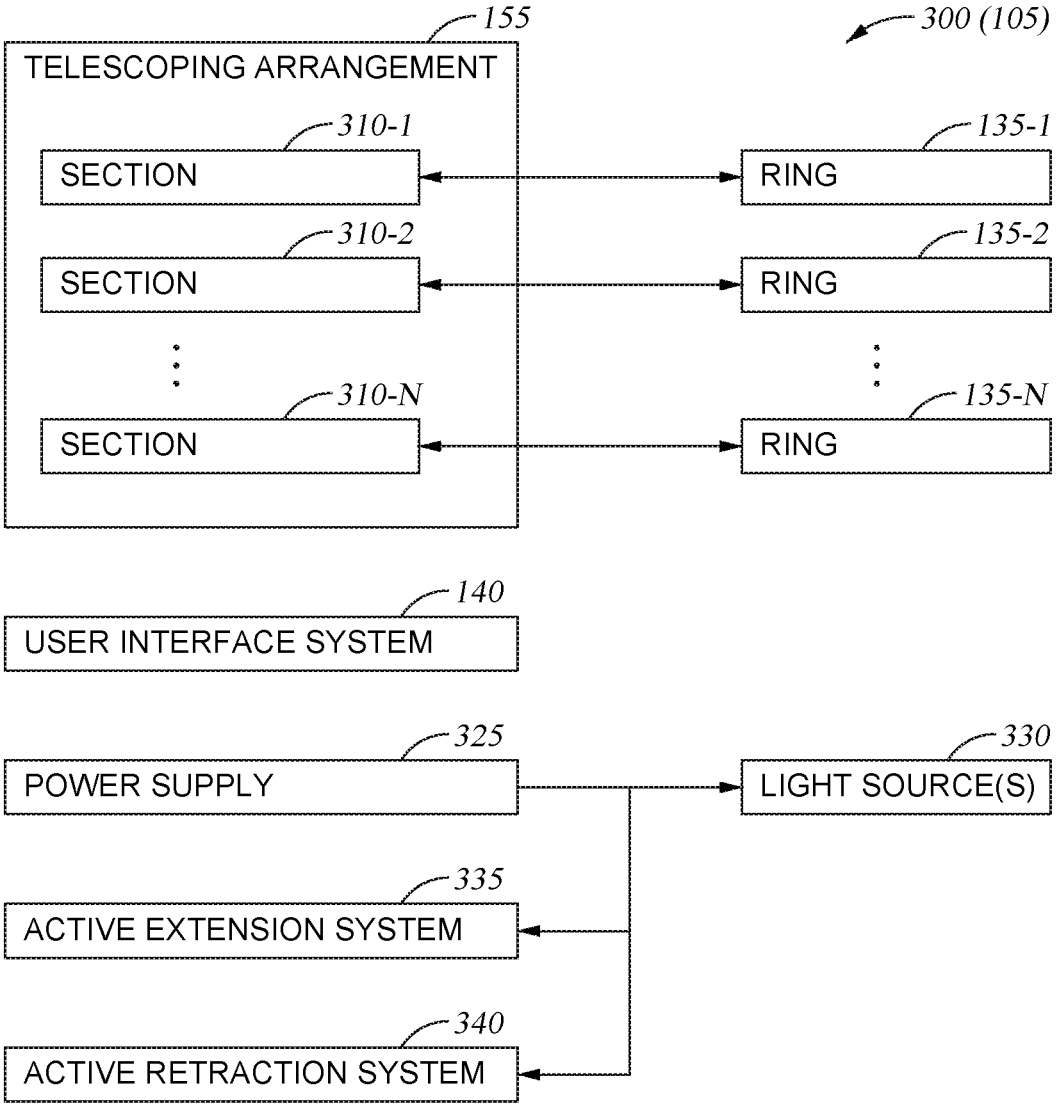
FIG. 3 is a block diagram of an exemplary apparatus having a telescoping arrangement, according to one or more embodiments.

FIG. 3 is a block diagram 300 of the exemplary apparatus 105 having the telescoping arrangement 155, according to one or more embodiments. The features depicted in the block diagram 300 may be used in conjunction with other embodiments.

The apparatus 105 comprises the telescoping arrangement 155, which comprises a plurality of sections 310-1, 310-2, . . . , 310-N (generically, a section 310), where the value of N is an integer greater than or equal to two (2). Adjacent sections 310 of the plurality of sections 310-1, 310-2, . . . , 310-N may be slidingly contacted with each other to achieve the telescoping function of the telescoping arrangement 155.

The apparatus 105 further comprises a plurality of rings 135-1, 135-2, . . . , 135-N (generically, a ring 135). Each ring 135 is attached with a respective section 310 and is dimensioned to be arranged around an arm of a user. For example, each ring 135 may have an inner diameter such that the plurality of rings 135-1, 135-2, . . . , 135-N are arranged around the arm when the telescoping arrangement 155 is in a retracted configuration.

The apparatus 105 further comprises the user interface system 140 that is attached with the telescoping arrangement 155 and that is arm-worn or hand-held by the user. When the user interface system 140 is arm-worn or hand-held by the user, the plurality of rings 135-1, 135-2, . . . , 135-N are arranged around the arm.

The apparatus 105 further comprises a power supply 325 that provides electrical power to one or more components included in the apparatus 105 and/or the plurality of rings 135-1, 135-2, . . . , 135-N. The power supply 325 may have any suitable implementation, and in some embodiments is dimensioned to be portable with the apparatus 105. In some embodiments, the power supply 325 comprises one or more rechargeable or single-use batteries. In some embodiments, the power supply 325 is stored in a housing of the apparatus 105 attached with the telescoping arrangement 155, and provides all electrical power to the components of the apparatus 105. In some embodiments, the power supply 325 in the housing provides electrical power to some of the components. For example, one or more batteries may also be included within each ring 135.

The apparatus 105 further comprises one or more light sources 330 used to illuminate the plurality of rings 135-1, 135-2, . . . , 135-N. The one or more light sources 330 may have any suitable implementation, such as LEDs. In some embodiments, each section 310 includes a respective light source 330. In some embodiments, each ring 135 includes a respective light source 330.

In some embodiments, the apparatus 105 further comprises an active extension system 335 that is used to extend the telescoping arrangement 155. In some embodiments, the active extension system 335 comprises an electric motor that controls tension on a line that engages portions of the plurality of sections 310-1, 310-2, . . . , 310-N to extend the telescoping arrangement 155 when tension on the line is increased. Additional discussion of the electric motor and line is provided below with respect to FIGS. 6, 7A, and 7B.

In some embodiments, the active extension system 355 comprises a compressed gas source. Pressure from the compressed gas source causes the telescoping arrangement 155 to extend. In one example, the telescoping arrangement 155 is implemented as a telescoping pneumatic cylinder (e.g., single-acting or double-acting) and the sections 310 are in fluid communication with each other and with the compressed gas source. In another example, the sections 310 are attached to a piston rod that extends responsive to pressure from the compressed gas source. Returning now to FIGS. 10A and 10B, the first portion 1005 of the user interface system 140 comprises a pneumatic cylinder 1015 representing one example of the compressed gas source. Other types of compressed gas sources, which may include user-actuated and non-user actuated types, are also contemplated. A piston rod 1020 extends from the pneumatic cylinder 1015 and attaches to an interface 1025 on the second portion 1010. In some embodiments, the piston rod 1020 is rotatably connected to the interface 1025, e.g., connected at a hinge attached to the interface 1025.

In the diagram 1000, the user's arm is in a forward-extended position (e.g., about 90 degrees shoulder flexion from a neutral position and about zero degrees elbow flexion). In the diagram 1030, the user has moved the arm upward from the forward-extended position using shoulder flexion 1040 and/or elbow flexion 1035. In some embodiments, the elbow flexion 1035 moves the pneumatic cylinder 1015 and causes the piston rod 1020 to encounter resistance from the upper arm 125 at the interface 1025. As a result, the piston rod 1020 is inserted further into the pneumatic cylinder 1015, causing an increased compression by the compressed gas source. In an alternate embodiments, elbow flexion by the user provides an electrical signal to increase pressure of the compressed gas source.

Returning now to FIG. 3, in some embodiments, the apparatus 105 further comprises an active retraction system 340 that is used to retract the telescoping arrangement 155. In some embodiments, the active retraction system 340 may share some or all of the components of the active extension system 335 (e.g., a double-acting telescoping pneumatic cylinder, a shared electric motor). In other embodiments, the active retraction system 340 may be independent of the active extension system 335.

Figure 4:
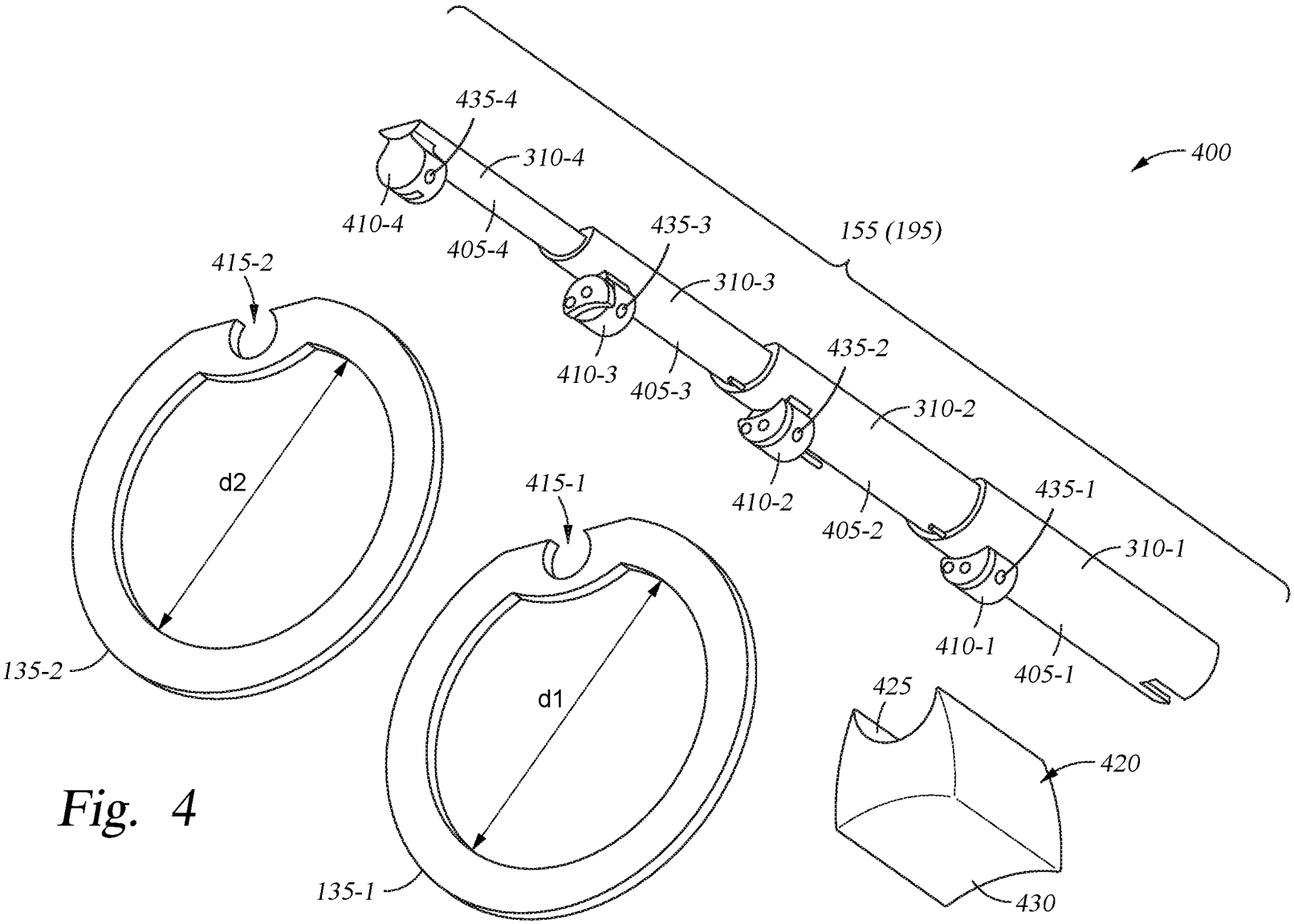
FIG. 4 is a partially exploded view of an exemplary apparatus with a telescoping arrangement in an extended configuration, according to one or more embodiments.

FIG. 4 is a partially exploded view 400 of an exemplary apparatus with a telescoping arrangement in an extended configuration, according to one or more embodiments. The features illustrated in FIG. 4 may be used in conjunction with other embodiments.

Each section 310-1, 310-2, 310-3, 310-4 comprises a respective body portion 405-1, 405-2, 405-3, 405-4 defining an exterior surface, and a respective projecting portion 410-1, 410-2, 410-3, 410-4 that projects from the exterior surface. In some embodiments, each of the body portions 405-1, 405-2, 405-3, 405-4 has a circular or semicircular profile. As shown in the partially exploded view 400, the body portions 405-1, 405-2, 405-3, 405-4 have a semicircular profile. In some embodiments, some or all of the sections 310 include rails or other guiding features (e.g., on a surface opposite to the exterior surface) that allow adjacent sections 310 to slide relative to each other.

Figure 5:
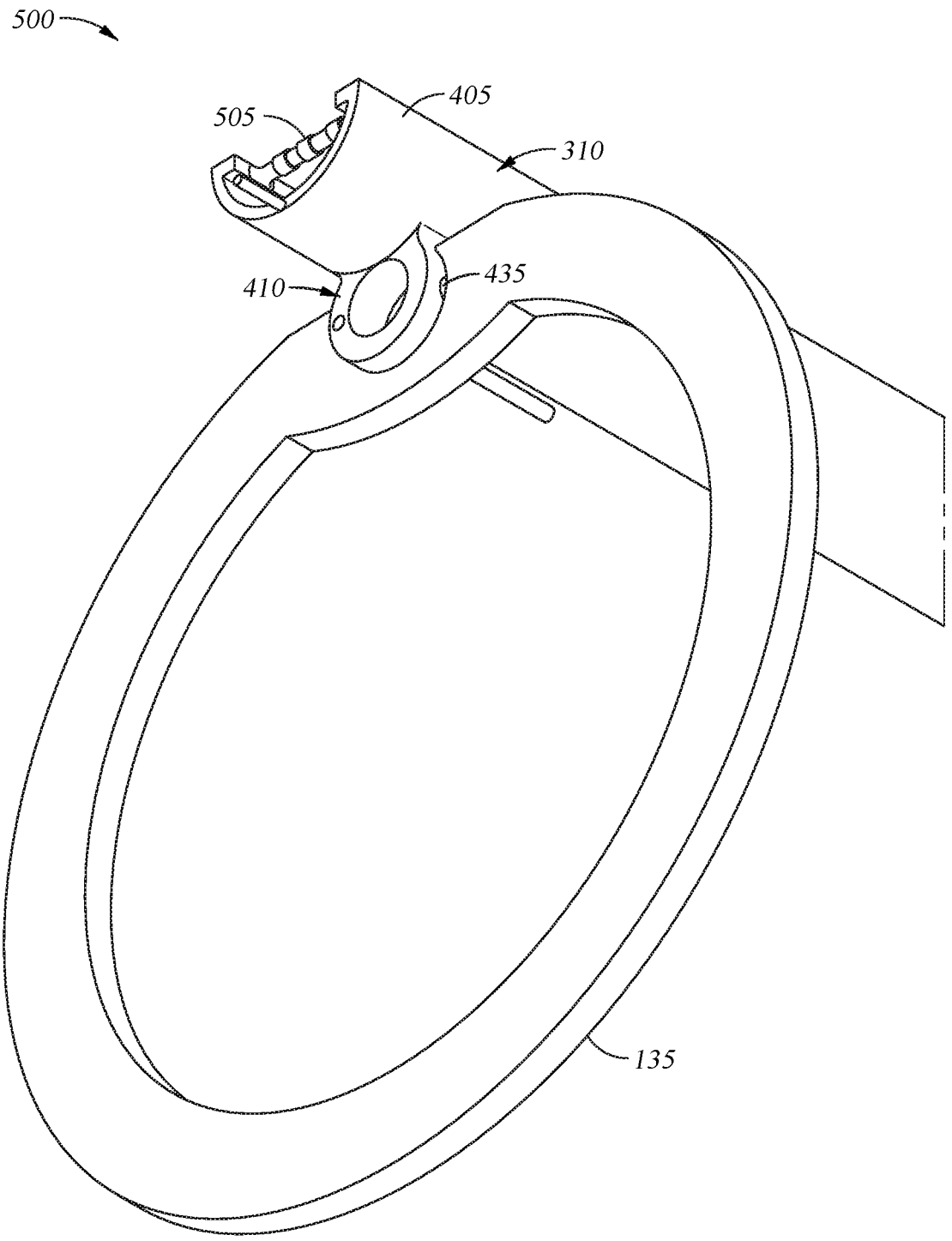
FIG. 5 illustrates an exemplary attachment of an illuminable ring with a section of a telescoping arrangement, according to one or more embodiments.

The rings 135-1, 135-2 define respective openings 415-1, 415-2 that are dimensioned to couple with the respective projecting portions 410-1, 410-2, which removably attaches the rings 135-1, 135-2 with the respective projecting portions 410-1, 410-2. In some embodiments, the projecting portions 410-1, 410-2, 410-3, 410-4 are dimensioned to retain the respective ring in the attached configuration (e.g., providing a friction fit, defining complementary features that mate with the ring, including a latch mechanism, and so forth). Diagram 500 of FIG. 5 illustrates an exemplary attachment of an illuminable ring 135 with a section 310 of a telescoping arrangement, according to one or more embodiments. More specifically, the diagram 500 depicts a body portion 405 with a semicircular profile and a crossmember 505 extending across the body portion 405. In some embodiments, the crossmember 505 comprises one or more ridges and one or more grooves that engage a line. The line may be wound around crossmembers 505 of respective sections 310, and an electric motor configured to control tension on the line to extend the telescoping arrangement when tension on the line is increased.

Returning to FIG. 4, each of the projecting portions 410-1, 410-2, 410-3, 410-4 comprises a respective communicative interface 435-1, 435-2, 435-3, 435-4 (generically, a communicative interface 435) for selectively illuminating the rings 135-1, 135-2 when attached. In some embodiments, each of the communicative interfaces 435-1, 435-2, 435-3, 435-4 comprises an optical interface. For example, LEDs included in the projecting portions 410-1, 410-2, 410-3, 410-4 may transmit light across the communicative interface 435-1, 435-2, 435-3, 435-4.

In some embodiments, the rings 135 are passive elements that illuminate responsive to receiving the light from the communicative interface 435. For example, the rings 135 may be formed of a transparent or translucent material that operates as a lightpipe. In other embodiments, the rings 135 may include one or more active electrical and/or optical components.

In some embodiments, each of the communicative interfaces 435 comprises an electrical (e.g., conductive) interface. For example, each of the rings 135 may include a respective LED, and power and/or signals may be communicated across the communicative interfaces 435 to cause the LED to be illuminated. In these cases, the rings 135 may include one or more other electrical and/or optical components.

In some embodiments, the rings 135-1, 135-2 may be similarly dimensioned to each other. For example, inner diameters d1, d2 may be equal, and openings 415-1, 415-2 formed in the rings 135-1, 135-2 may be equally sized. To coaxially align the rings 135-1, 135-2, the projecting portions 410-1, 410-2, 410-3, 410-4 may be dimensioned differently. For example, the projecting portion 410-4 may be taller than the projecting portion 410-1 to compensate for the body portion 405-4 being smaller than the body portion 405-1.

In some embodiments, a first section 310 of the plurality of sections (e.g., the section 310-1) further comprises a switch disposed in the corresponding projecting portion 410 (e.g., the projecting portion 410-1) of the section 310-1. The switch is open when the telescoping arrangement 155 is in the retracted configuration, and the switch is closed when the telescoping arrangement 155 is in the extended configuration 195. The ring 135 attached with the first section 310 is configured to illuminate when the switch is closed.

In some embodiments, a second section 310 of the plurality of sections (e.g., the section 310-2) is arranged adjacent to the section 310-1 in the telescoping arrangement 155. The switch is open when a second projecting portion 410 (e.g., the projecting portion 410-2) of the second section 310 is within a predefined distance from the first projecting portion 410. The switch is closed when the second projecting portion 410 is at a greater distance from the first projecting portion 410 than the predefined distance.

In some embodiments, a pin extending from the second projecting portion 410 prevents the switch from closing when the pin is received by the first projecting portion 410. Other proximity sensing techniques between the adjacent projecting portions 410 are also contemplated, e.g., sensors disposed within the projecting portions 410.

In some embodiments, the apparatus further comprises a housing 420 attached with a first section 310 (e.g., the section 310-1) of the plurality of sections. One or more components of the apparatus may be at least partially disposed in the housing 420. For example, the housing 420 may include one or more batteries, some or all of an active extension system, and/or some or all of an active retraction system. The housing 420 defines a first exterior surface 425 that is contoured to interface with the section 310-1, and a second exterior surface 430 that is contoured to interface with a portion of the arm. For example, the second exterior surface 430 may have a greater radius of curvature than the first exterior surface 425.

In some embodiments, conductive connections may extend from the housing 420 to provide power and/or signaling to each of the sections 310. In one example, the conductive connections comprise wires. In another example, the sections 310 may include a conducting tape, film, etc. that maintains the conductive connections between adjacent sections 310 as the sections 310 slide relative to each other.

Figure 6:
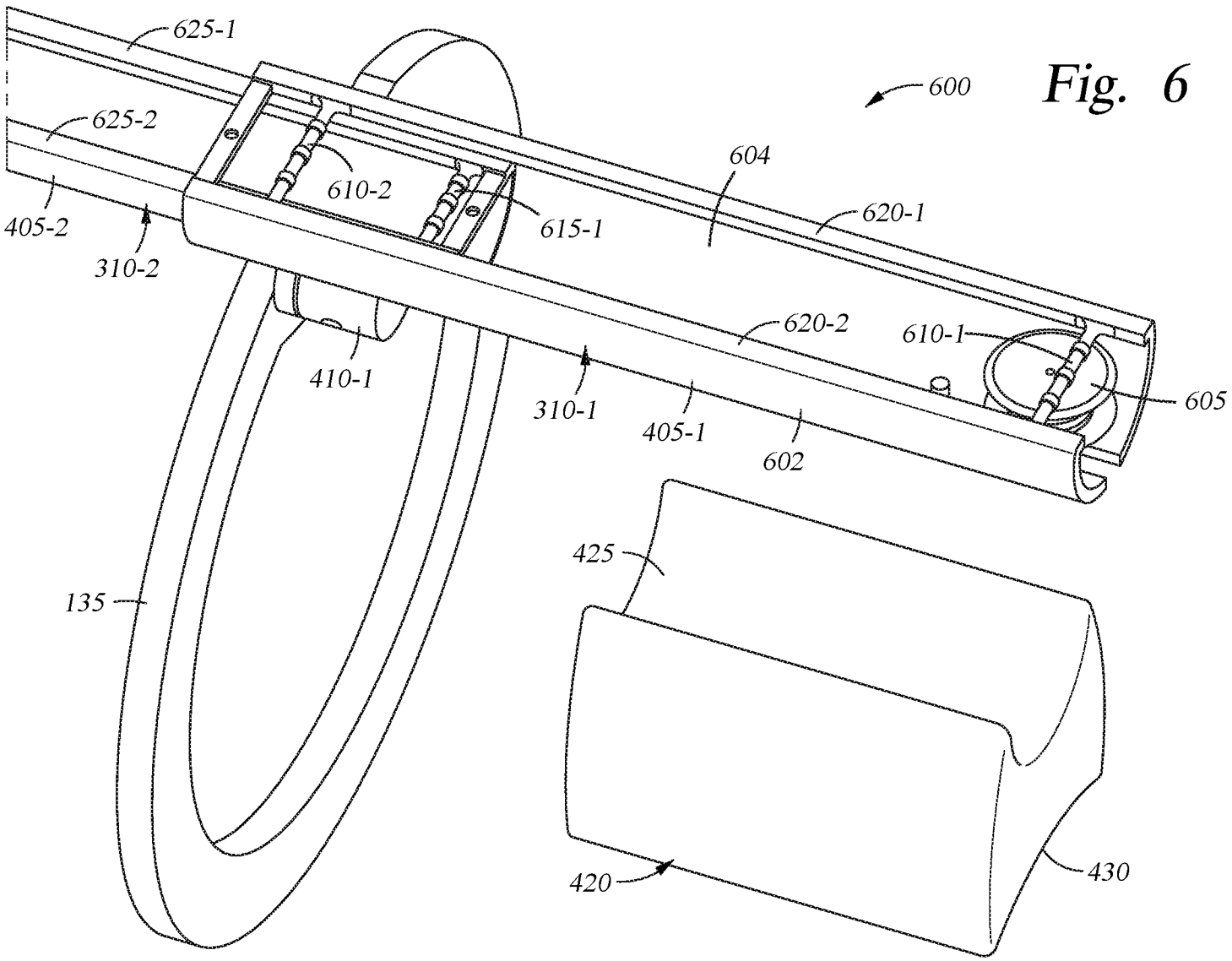
FIG. 6 illustrates a sliding engagement of sections of a telescoping arrangement, according to one or more embodiments.

FIG. 6 illustrates a sliding engagement of sections of a telescoping arrangement, according to one or more embodiments. More specifically, diagram 600 is a bottom perspective view corresponding to a portion of the partially exploded view 400 of FIG. 4. The features illustrated in the diagram 600 may be used in conjunction with other embodiments.

In the diagram 600, the body portion 405-1 of the section 310-1 has a semicircular profile. The body portion 405-1 defines an exterior surface 602 and an interior surface 604 opposite the exterior surface 602. The body portion 405-1 defines rails 620-1, 620-2 that are arranged along the interior surface 604. The rails 620-1, 620-2 extend along a longitudinal axis of the body portion 405-1. The section 310-2 includes rails 625-1, 625-2 that may be configured similarly to the rails 620-1, 620-2. As shown, top surfaces of the rails 620-1, 620-2 are slidingly coupled with bottom surfaces of the rails 625-1, 625-2.

The section 310-1 further comprises a spool 605 attached with the interior surface 604. Crossmembers 610-1, 610-2 extend across the body portion 405-1, and crossmember 615-1 extends across the body portion 405-2 of the section 310-2. The crossmembers 610-1, 610-2, 615-1 represent examples of the crossmember 505 of FIG. 5. Each of the crossmembers 610-1, 610-2 extends between the rails 620-1, 620-2, and the crossmember 615-1 extends between the rails 625-1, 625-2 As shown, the crossmembers 610-1, 610-2 are spaced apart from each other and are arranged near ends of the body portion 405-1 along the longitudinal axis. Each of the crossmembers 610-1, 610-2, 615-1 comprises one or more ridges and one or more grooves that engage a line (e.g., a string made of a suitable natural or synthetic material). Thus, an electric motor (e.g., an example of an active extension system 335 and/or an active retraction system 340) may be arranged in the housing 420, and the line is attached to the electric motor and wound around the spool 605 and the crossmembers 610-1, 610-2, 615-1. When the electric motor increases tension on the line, the telescoping arrangement extends. For example, the line may be sequentially wound around the spool 605, the crossmember 610-1, the crossmember 610-2, and the crossmember 615-1, such that increasing the tension on the line causes the crossmember 615-1 to be pulled toward the crossmember 610-2, which causes the section 310-2 to slide away from the section 310-1 and extends the telescoping arrangement.

Figure 7A:
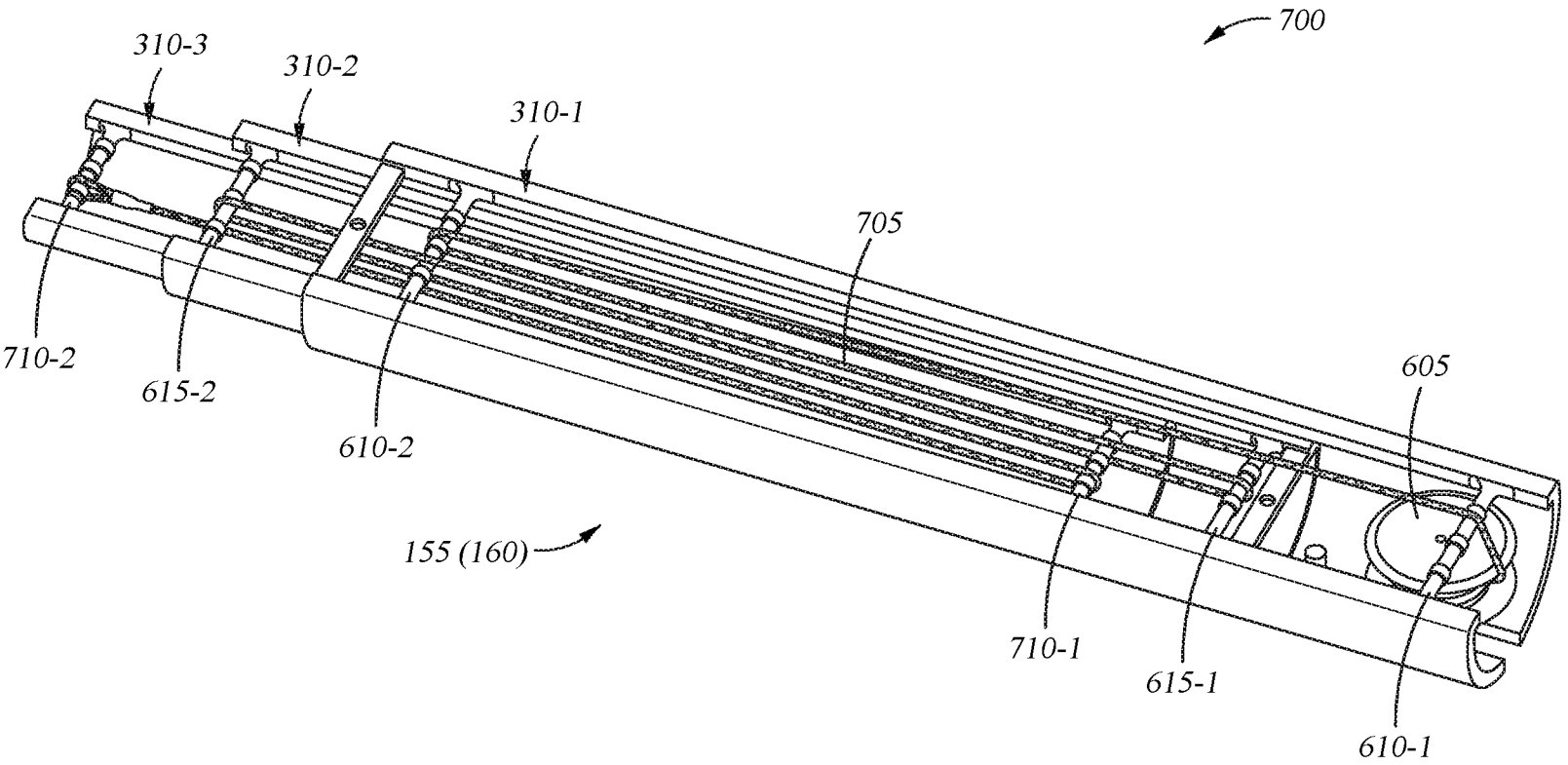
FIGS. 7A and 7B illustrate extending a telescoping arrangement using tension on a line, according to one or more embodiments.
Figure 7B:
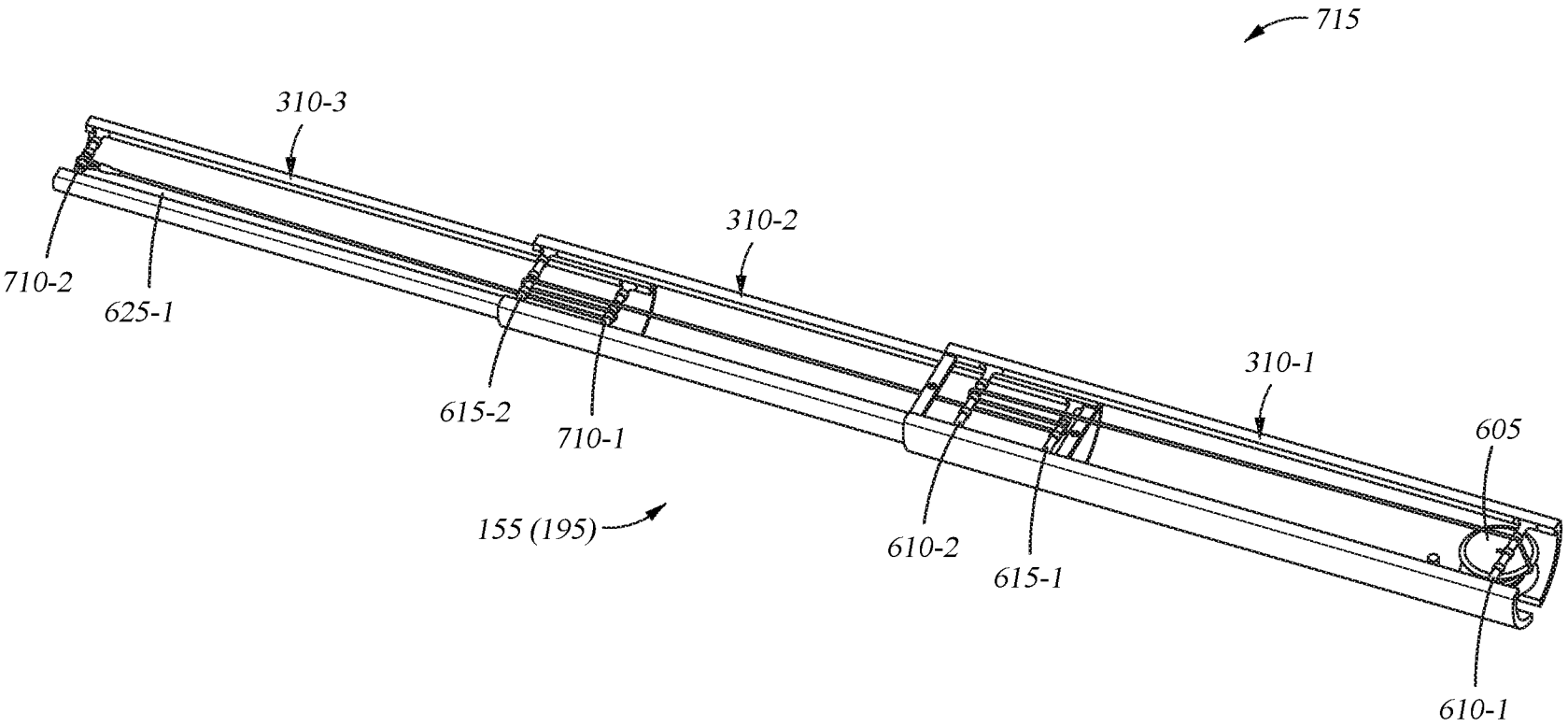

FIGS. 7A and 7B illustrate extending the telescoping arrangement 155 using tension on a line, according to one or more embodiments. More specifically, diagram 700 illustrates an implementation of the telescoping arrangement 155 with three sections 310-1, 310-2, 310-3 in the retracted configuration 160, and diagram 715 illustrates the telescoping arrangement 155 in the extended configuration 195. The features illustrated in the diagrams 700, 715 may be used in conjunction with other embodiments.

The section 310-1 comprises the crossmembers 610-1, 610-2, the section 310-2 comprises the crossmembers 615-1, 615-2, and the section 310-3 comprises the crossmembers 710-1, 710-2 (which may be configured similarly to the crossmembers 610-1, 610-2, 615-1, 615-2). In the diagram 700, a line 705 is sequentially wound around the spool 605, the crossmember 610-1, the crossmember 610-2, the crossmember 615-1, the crossmember 615-2, the crossmember 710-1, and the crossmember 710-2. As the electric motor increases the tension on the line 705, the crossmember 615-1 is pulled toward the crossmember 610-2, and the crossmember 710-1 is pulled toward the crossmember 615-2, which causes the telescoping arrangement 155 to extend into the extended configuration 195 shown in the diagram 715.

As discussed above, some embodiments of the apparatus may include an active retraction system that returns the telescoping arrangement 155 to the retracted configuration 160. Using the implementation of the diagram 700, the active retraction system may use the same or a different electric motor that increases tension on another line, which is wound around some or all of the crossmembers 610-1, 610-2, 615-1, 615-2, 710-1, and 710-2, to pull the crossmembers 610-1, 610-2, 615-1, 615-2, 710-1, and 710-2 inward (i.e., toward the retracted configuration 160).

Figure 8A:
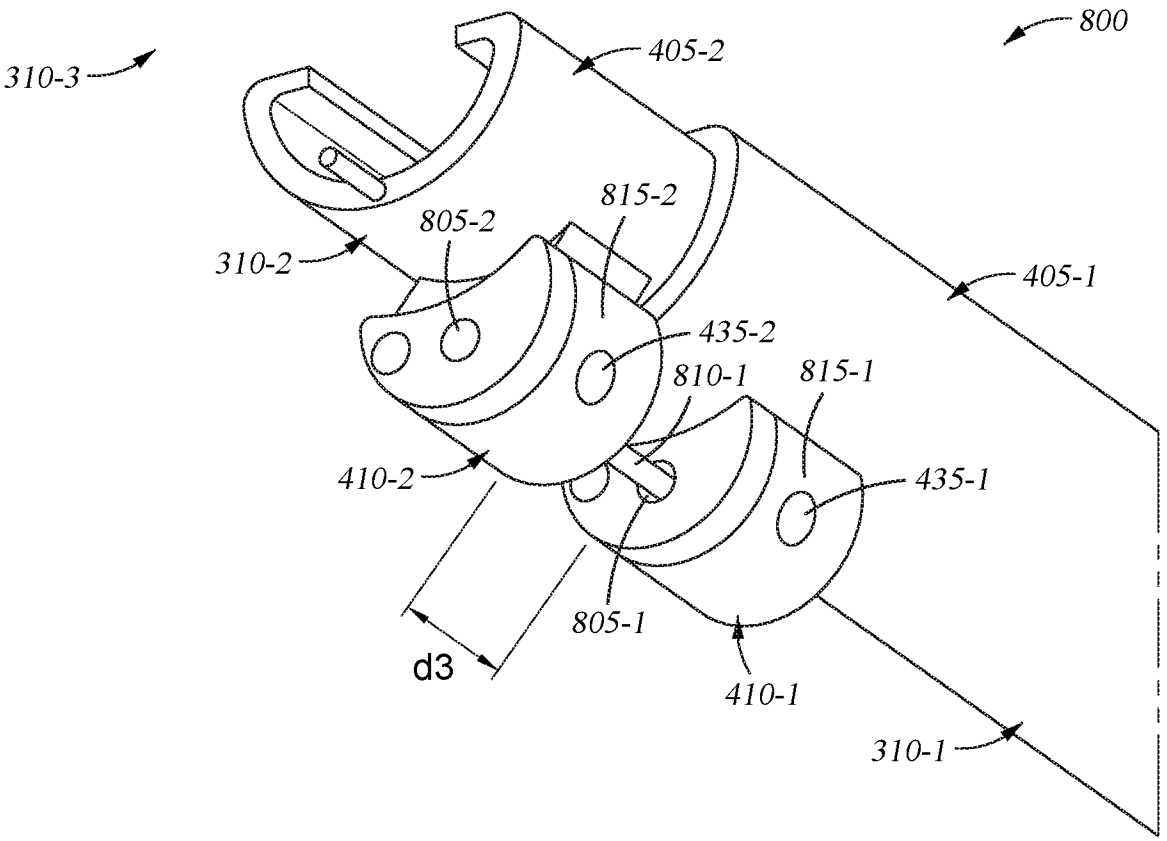
FIGS. 8A and 8B illustrate projecting portions of adjacent sections of a telescoping arrangement, according to one or more embodiments.
Figure 8B:
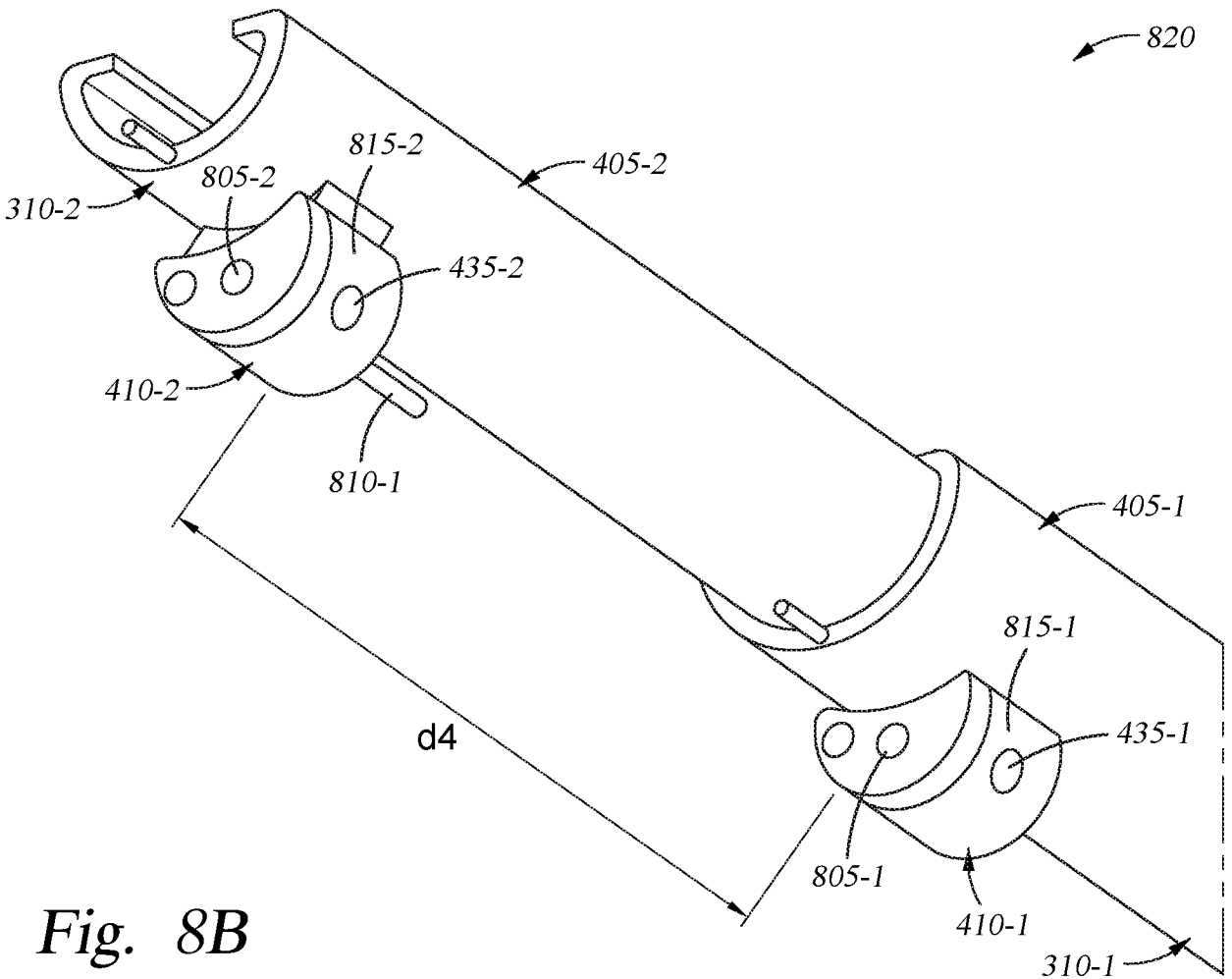

FIGS. 8A and 8B illustrate projecting portions 410-1, 410-2 of adjacent sections 310-1, 310-2 of a telescoping arrangement, according to one or more embodiments. The features illustrated in diagrams 800, 820 may be used in conjunction with other embodiments.

A switch 815-1 is disposed in the projecting portion 410-1 and a switch 815-2 is disposed in the projecting portion 410-2. The switches 815-1, 815-2 are open when the telescoping arrangement is in the retracted configuration, and the switches 815-1, 815-2 are closed when the telescoping arrangement is in the extended configuration. In some embodiments, the rings attached with the sections 310-1, 310-2 are configured to illuminate when the respective switches 815-1, 815-2 are closed. In some embodiments, the rings illuminate sequentially as the telescoping arrangement extends. In other embodiments, the rings illuminate simultaneously or with another ordering.

In some embodiments, the switch 815-1 is open when the projecting portion 410-2 is within a predefined distance from the projecting portion 410-1, and the switch 815-1 is closed when the projecting portion 410-2 is at a greater distance from the projecting portion 410-1 than the predefined distance. In the diagram 800, the projecting portions 410-1, 410-2 are at a distance d3 from each other, where the distance d3 is less than the predefined distance. In the diagram 820, the projecting portions 410-1, 410-2 are at a distance d4 from each other, where the distance d4 is greater than the predefined distance.

The switch 815-1 may be closed and opened using any suitable proximity sensing techniques between the projecting portions 410-1, 410-2. In some embodiments, the projecting portion 410-1 may include a proximity sensor. In some embodiments, a pin 810-1 extends from the projecting portion 410-2 that is received by an opening 805-1 defined in the projecting portion 410-1. An opening 805-2 is defined in the projecting portion 410-2 and is dimensioned to receive a pin from an adjacent section 310-3 (not shown). When the projecting portions 410-1, 410-2 are at the distance d3, the pin 810-1 is received in the opening 805-1 and prevents the switch 815-1 from closing. When the projecting portions 410-1, 410-2 are at the distance d4, the pin 810-1 is outside the opening 805-1 and the switch 815-1 is closed. In some embodiments, closing the switch 815-1 establishes electrical contact with a power supply to cause the corresponding ring to illuminate.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

In the preceding, reference is made to embodiments presented in this disclosure. However, the scope of the present disclosure is not limited to specific described embodiments. Instead, any combination of the features and elements described herein, whether related to different embodiments or not, is contemplated to implement and practice contemplated embodiments. Furthermore, although embodiments disclosed herein may achieve advantages over other possible solutions or over the prior art, whether or not a particular advantage is achieved by a given embodiment is not limiting of the scope of the present disclosure. Thus, the aspects, features, embodiments and advantages described herein are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s).

Aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system."

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

While the foregoing is directed to embodiments of the present invention, other and further embodiments of the invention may be devised without departing from the basic scope thereof, and the scope thereof is determined by the claims that follow.

What is claimed is:

1. An arm-wearable apparatus comprising:

a telescoping arrangement comprising a plurality of sections;

a user interface system configured to removably attach the telescoping arrangement with an arm of a wearer; and a plurality of illuminable rings, wherein each ring of the plurality of illuminable rings is attached with a respective section of the plurality of sections and has an inner diameter such that the plurality of illuminable rings form an opening to receive the arm when the telescoping arrangement is in a retracted configuration, and wherein at least some of the plurality of illuminable rings are arranged beyond an extent of the arm when the telescoping arrangement in an extended configuration.

2. The arm-wearable apparatus of claim 1, wherein each section of the plurality of sections comprises:

a body portion defining an exterior surface; and a projecting portion that projects from the exterior surface, wherein each ring of the plurality of illuminable rings is configured to removably attach with the projecting portion of the respective section.

3. The arm-wearable apparatus of claim 2, wherein the body portion has a circular or semicircular profile.

4. The arm-wearable apparatus of claim 2, wherein a first section of the plurality of sections further comprises:

a switch disposed in a first projecting portion of the first section, wherein the switch is open when the telescoping arrangement is in the retracted configuration, wherein the switch is closed when the telescoping arrangement is in the extended configuration, and wherein the ring attached with the first section is configured to illuminate when the switch is closed.

5. The arm-wearable apparatus of claim 4, wherein a second section of the plurality of sections is arranged adjacent to the first section in the telescoping arrangement, wherein the switch is open when a second projecting portion of the second section is within a predefined distance from the first projecting portion, and wherein the switch is closed when the second projecting portion is at a greater distance from the first projecting portion than the predefined distance.

6. The arm-wearable apparatus of claim 5, wherein a pin extending from the second projecting portion prevents the switch from closing when the pin is received by the first projecting portion.

7. The arm-wearable apparatus of claim 1, wherein the telescoping arrangement is configured to extend from the retracted configuration to the extended configuration responsive to force applied through one or both of: shoulder extension and elbow extension by the wearer.

8. The arm-wearable apparatus of claim 1, further comprising:

a housing attached with a first section of the plurality of sections; and an active extension system disposed at least partially in the housing, the active extension system configured to, responsive to an input, extend the telescoping arrangement.

9. The arm-wearable apparatus of claim 8, wherein the active extension system comprises:

an electric motor configured to control tension on a line, wherein the line engages portions of the plurality of sections to extend the telescoping arrangement when tension on the line is increased.

10. The arm-wearable apparatus of claim 8, wherein the active extension system comprises a compressed gas source.

11. The arm-wearable apparatus of claim 10, wherein the user interface system comprises:

a first portion configured to be removably attached to a forearm of the arm; and a second portion attached with the first portion and configured to couple with an upper arm of the arm, wherein elbow flexion by the wearer causes an increased compression by the compressed gas source.

12. The arm-wearable apparatus of claim 1, further comprising:

a housing attached with a first section of the plurality of sections; and an active retraction system disposed at least partially in the housing, the active retraction system configured to, responsive to an input, retract the telescoping arrangement.

13. An apparatus comprising:

a telescoping arrangement comprising a plurality of sections;

a plurality of rings, wherein each ring of the plurality of rings is attached with a respective section of the plurality of sections;

a user interface system attached with the telescoping arrangement and configured to be arm-worn or hand-held by a user, wherein the user interface system when arm-worn or hand-held causes the plurality of rings to form an opening to receive an arm of the user; and an active extension system coupled with the telescoping arrangement, wherein the telescoping arrangement is configured to extend from a retracted configuration to an extended configuration responsive to each of:

force applied through movement of the arm within a sagittal plane; and an input to the active extension system.

14. The apparatus of claim 13, wherein the movement of the arm within the sagittal plane comprises one or more of:

shoulder flexion;

shoulder extension;

elbow flexion; and elbow extension.

15. The apparatus of claim 13, wherein the active extension system comprises:

an electric motor configured to control tension on a line, wherein the line engages portions of the plurality of sections to extend the telescoping arrangement when tension on the line is increased.

16. The apparatus of claim 13, wherein the active extension system comprises a compressed gas source.

17. The apparatus of claim 16, wherein the user interface system comprises:

a first portion configured to be removably attached to a forearm of the arm; and a second portion attached with the first portion and configured to couple with an upper arm of the arm, wherein elbow flexion by the user causes an increased compression by the compressed gas source.

18. The apparatus of claim 13, wherein the plurality of rings are configured to illuminate as the telescoping arrangement extends.

19. A method comprising:

arranging a plurality of rings around an arm of a user, wherein each ring of the plurality of rings is attached with a respective section of a telescoping arrangement, wherein arranging the plurality of rings around the arm of the user occurs when a user interface system, attached with the telescoping arrangement, is arm-worn or hand-held by the user; and responsive to receiving an input from the user, extending the telescoping arrangement from a retracted configuration to an extended configuration, wherein receiving the input from the user is one of: applying force applied through movement of the arm within a sagittal plane, and receiving an input to an active extension system.

20. The method of claim 19, further comprising:

illuminating the plurality of rings as the telescoping arrangement extends.

* * * * *